US007827633B2

(12) United States Patent
Taylor

(10) Patent No.: US 7,827,633 B2
(45) Date of Patent: Nov. 9, 2010

(54) BED CLOTHING ASSEMBLY

(76) Inventor: Barbara Taylor, 1511 Bonniebrook Dr., Lutz, FL (US) 33549

( * ) Notice: Subject to any disclaimer, the term of this patent is extended or adjusted under 35 U.S.C. 154(b) by 0 days.

(21) Appl. No.: 12/263,577

(22) Filed: Nov. 3, 2008

(65) Prior Publication Data

US 2010/0107337 A1 May 6, 2010

(51) Int. Cl.
*A47C 31/00* (2006.01)

(52) U.S. Cl. ..... 5/500; 5/488; 5/502

(58) Field of Classification Search ..... 5/482, 5/487, 488, 493, 495, 496, 497, 498, 499, 5/500, 502
See application file for complete search history.

(56) References Cited

U.S. PATENT DOCUMENTS

| | | | | | |
|---|---|---|---|---|---|
| 4,488,323 | A * | 12/1984 | Colburn | 5/692 |
| 4,651,371 | A | 3/1987 | Hahn | |
| 4,833,744 | A | 5/1989 | Correa | |
| 4,899,407 | A | 2/1990 | McCue | |
| 4,916,766 | A | 4/1990 | Grandy | |
| 5,003,655 | A * | 4/1991 | Kafai | 5/496 |
| 5,010,610 | A * | 4/1991 | Ackley | 5/691 |
| 5,020,177 | A | 6/1991 | Etherington | |
| 5,367,729 | A | 11/1994 | Lazar et al. | |
| 5,557,814 | A | 9/1996 | Cybulski | |
| 5,572,754 | A | 11/1996 | Lazar et al. | |
| 5,666,680 | A | 9/1997 | Hackett, Jr. | |
| 6,009,579 | A * | 1/2000 | Pedersen | 5/690 |
| 6,098,219 | A * | 8/2000 | Milber | 5/494 |
| 6,243,895 | B1 | 6/2001 | Amin | |
| 6,886,197 | B1 * | 5/2005 | Madigan | 5/482 |
| 7,007,325 | B1 * | 3/2006 | Gomeh | 5/496 |
| 2006/0053553 | A1 * | 3/2006 | Gomeh | 5/502 |
| 2007/0251006 | A1 * | 11/2007 | Kennett | 5/493 |

* cited by examiner

*Primary Examiner*—Michael Trettel
*Assistant Examiner*—William Kelleher
(74) *Attorney, Agent, or Firm*—Maxey Law Offices, PLLC; Stephen Lewellyn

(57) ABSTRACT

A bed clothing assembly for a mattress including a mattress band and a unitary sheet assembly that is removably attachable to the mattress band for attaching and changing bedding. The mattress band encircles the sidewall of the mattress, and includes upper and lower edge portions that extending inwardly and continuously around the peripheral edges of the top and bottom surfaces of the mattress, respectively, when the mattress band is installed on the mattress. The unitary sheet assembly includes a bottom sheet and top sheet connected together as one unit. A plurality of fasteners around the bottom sheet permit the detachable securment of the bottom sheet to the mattress band to facilitate placing the unitary sheet assembly on the mattress. This particular construction and arrangement is advantageous to a person that is physically disabled and permits easy changing of bedding without having to lift the mattress.

4 Claims, 4 Drawing Sheets

BED CLOTHING ASSEMBLY

FILED OF THE INVENTION

The present invention relates generally to bedding, and more particularly, relating to a bed clothing assembly that permits secure and removably attachment of bedding to a mattress.

BACKGROUND OF THE INVENTION

In maintaining a bed, it is necessary to make the bed daily and occasionally change and replace the bed sheets. Typically, bedding includes a bottom sheet that is placed on the mattress of the bed and secured either by tucking the edges of the sheet under the mattress, or in a fitted sheet, by stretching the corners of the sheet over the corners of the mattress. A top sheet is then placed overtop the bottom sheet and secured by tucking at least the foot end under the mattress. A padded sheet or a mattress pad is occasionally placed on top of the mattress prior to placement of the bottom sheet. Anyone that has made a bed is aware of how difficult, time consuming and straining it can be. This is particularly the case when the mattress needs to be repeatedly lifted to secure the bed sheets. The daily chore of making a bed and changing bed sheets is even more difficult and straining for the person that is physically disabled and/or wheelchair dependent.

SUMMARY OF THE INVENTION

In general, in one aspect, a bed clothing assembly for a mattress having top and bottom surfaces and a sidewall extending between the peripheral edges of the top and bottom surfaces is provided. The bed clothing assembly includes a mattress band having a sidewall with continuous upper and lower edges, an upper edge portion extending inwardly from the sidewall, and a lower edge portion extending inwardly from the sidewall. The sidewall of the mattress band encircling the sidewall of the mattress, and the upper and lower edge portions extending inwardly and continuously around the peripheral edges of the top and bottom surfaces of the mattress, respectively, when the mattress band is installed on the mattress. A unitary sheet assembly for overlaying the mattress. The unitary sheet assembly including a bottom sheet having a main panel with top and bottom surfaces and a peripheral edge, the bottom sheet further having a sidewall extending from the main panel thereof around the peripheral edge thereof and the sidewall of the bottom sheet having a peripheral bottom edge. A top sheet having a main panel with top and bottom surfaces and a peripheral edge. The top sheet further having a sidewall extending from the main panel thereof around a portion of the peripheral edge thereof, and the sidewall of the top sheet having a peripheral bottom edge. The bottom sheet and the top sheet being attached together along an adjacent portion of the peripheral bottom edges thereof with the remaining portion of the peripheral bottom edge of the top sheet being free from attachment with the top sheet. Attachment means for removably attaching the unitary sheet assembly to the mattress band with the sidewall of the bottom sheet coextensive with the sidewall of the mattress band.

A padded sheet for overlaying the mattress can be provided and can have a panel area sized equal to the top surface of the mattress. A second attachment means for removably attaching the padded sheet to the mattress band with the padded sheet positioned intermediate the bottom sheet and the upper surface of the mattress can be provided. The attachment means can attach the sidewall of the bottom sheet to the sidewall of the mattress band. The second attachment means can include a plurality of looped straps extending from and space along a peripheral edge of the padded sheet, and a hook fastener portion on each looped strap that is engagable with the sidewall of the mattress band. The main panel of the bottom sheet can be sized equal to the top surface of the mattress.

In general, in another aspect, a bed clothing assembly for a mattress having top and bottom surfaces, and a side wall with opposed ends, and opposed sides extending between peripheral edges of the top and bottom surfaces is provided. The bed clothing assembly includes a mattress band having a sidewall with continuous upper and lower edges. The sidewall of the mattress band including side panels and ends panels for covering the sides and ends, respectively, of the mattress. Adjacent vertical edges of the side panels and the end panels of the mattress band being joined to form vertical corners. The mattress band further having an upper edge portion extending inwardly from the sidewall, and a lower edge portion extending inwardly from the sidewall, wherein the sidewall of the mattress band encircles the sidewall of the mattress, and the upper and lower edge portions extending inwardly and continuously around the peripheral edges of the top and bottom surfaces of the mattress, respectively, when the mattress band is installed on the mattress. A unitary sheet assembly for overlaying the mattress. The unitary sheet assembly including a bottom sheet having a main panel with top and bottom surfaces and a peripheral edge. The bottom sheet having a sidewall extending from the main panel thereof continuously around the peripheral edge of the main panel. The sidewall of the bottom sheet including side panels and end panels for covering the side panels and end panels, respectively, of the mattress band. Adjacent vertical edges of the side panels and the end panels of the bottom sheet being joined to form vertical corners. The sidewall of the bottom sheet having a peripheral bottom edge, and the main panel of the bottom sheet being sized equal to the top surface of the mattress. A top sheet having a main panel with top and bottom surfaces and a peripheral edge. The top sheet having a sidewall extending from the peripheral edge of the main panel. The sidewall of the top sheet including a foot panel and side panels for covering one end panel of the end panels and the side panels, respectively, of the sidewall of the bottom sheet. The sidewall of the top sheet having a peripheral bottom edge. Adjacent vertical edges of the foot panel and the side panels of the top sheet being separate and forming vertical gaps therebetween. The peripheral bottom edge along the foot panel of the top sheet and the peripheral bottom edge along a cooperating end panel of the bottom sheet being continuously attached together along the lengths thereof with the remaining portion of the peripheral bottom edge along the side panels of the top sheet being free from attachment to the bottom sheet. A first attachment means for removably attaching the unitary sheet assembly to the mattress band with the sidewall of the bottom sheet coextensive with the sidewall of the mattress band. A padded sheet for overlaying the mattress and having a panel area sized equal to the upper surface of the mattress. Second attachment means for removably attaching the padded sheet to the mattress band with the padded sheet positioned intermediate the bottom sheet and the top surface of the mattress.

The first attachment means can attach the sidewall of the bottom sheet to the sidewall of the mattress band. The second attachment means can include a plurality of looped straps extending from and space along a peripheral edge of the padded sheet, and a hook fastener portion on each looped strap that is engagable with the sidewall of the mattress band.

The first attachment means can include a plurality of hook fasteners spaced along the peripheral bottom edge of the sidewall of the bottom sheet, each of the plurality of hook fasteners engagable with the sidewall of the mattress band. An elasticized material can be around the ends of each of the upper edge portion and the lower edge portion.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The accompanying drawings, which are included to provide further understanding of the invention and are incorporated in and constitute a part of this specification, illustrate preferred embodiments of the invention and together with the description serve to explain the principles of the invention, in which.

DETAILED DESCRIPTION OF THE INVENTION

Figure 1:
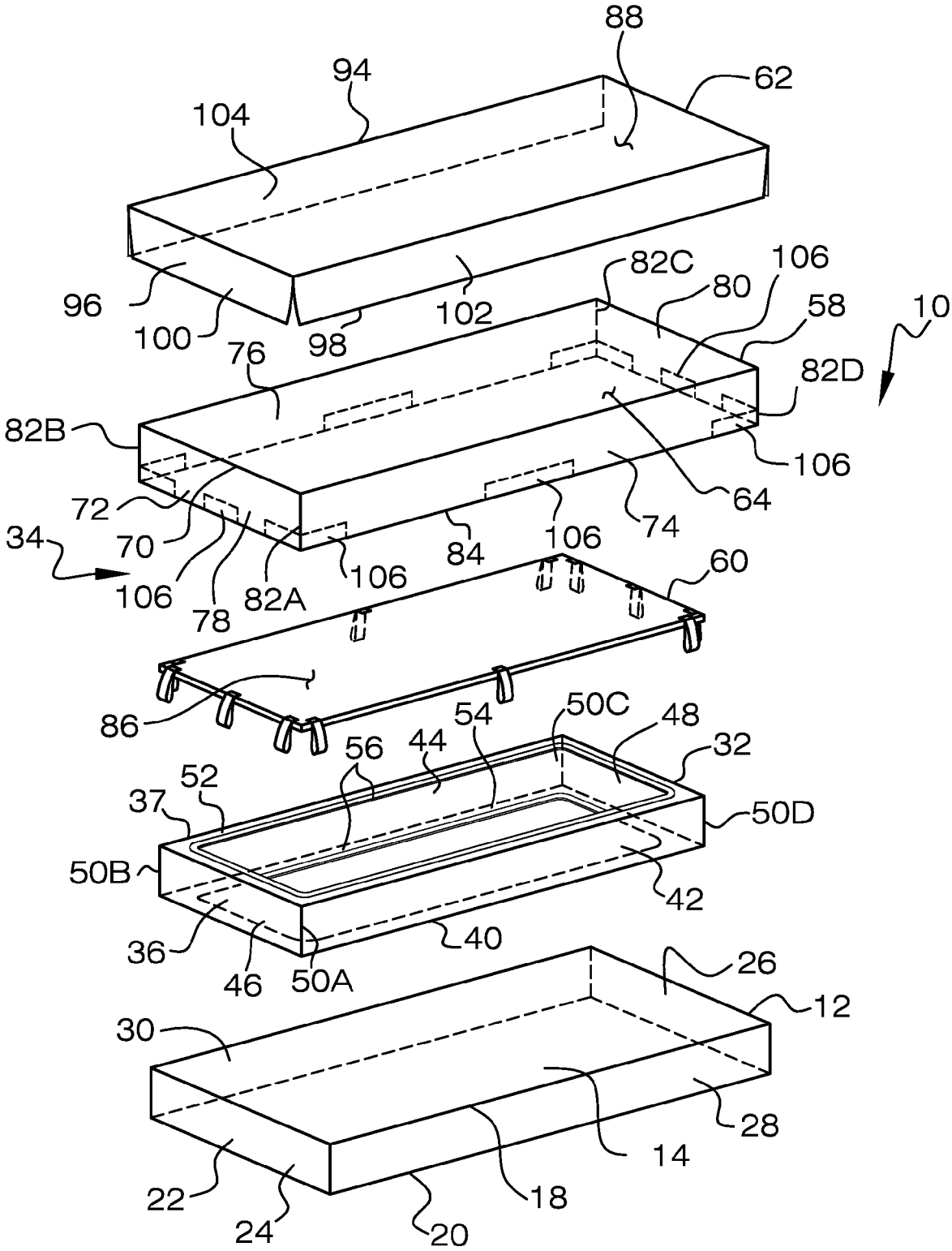
FIG. 1 is a perspective exploded view of the bed clothing assembly constructed in accordance with the principles of the present invention, and a conventional mattress with the bed clothing assembly unassembled.
Figure 2:
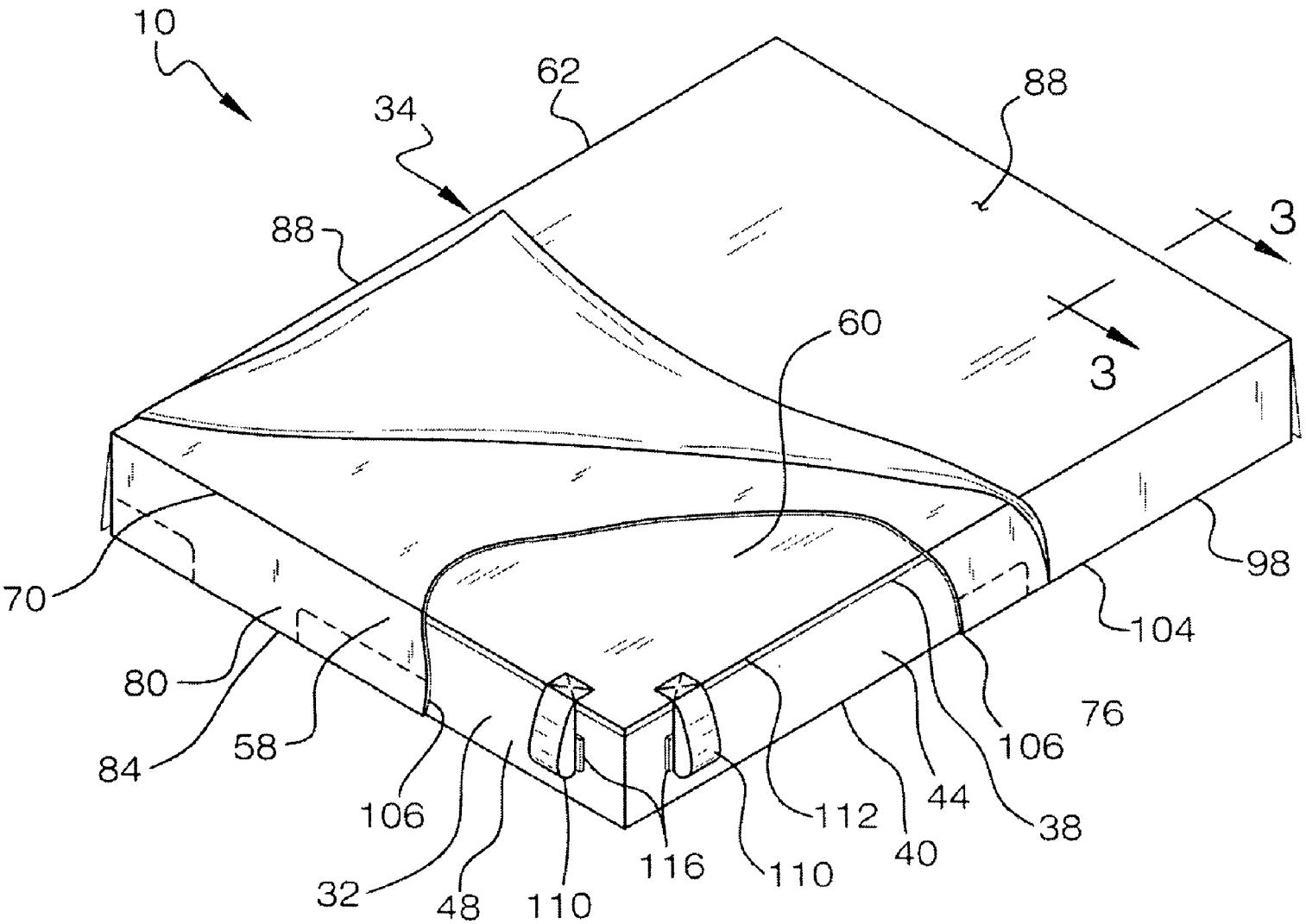
FIG. 2 is a perspective and partial cross section view of the bed clothing assembly on the mattress.
Figure 3:
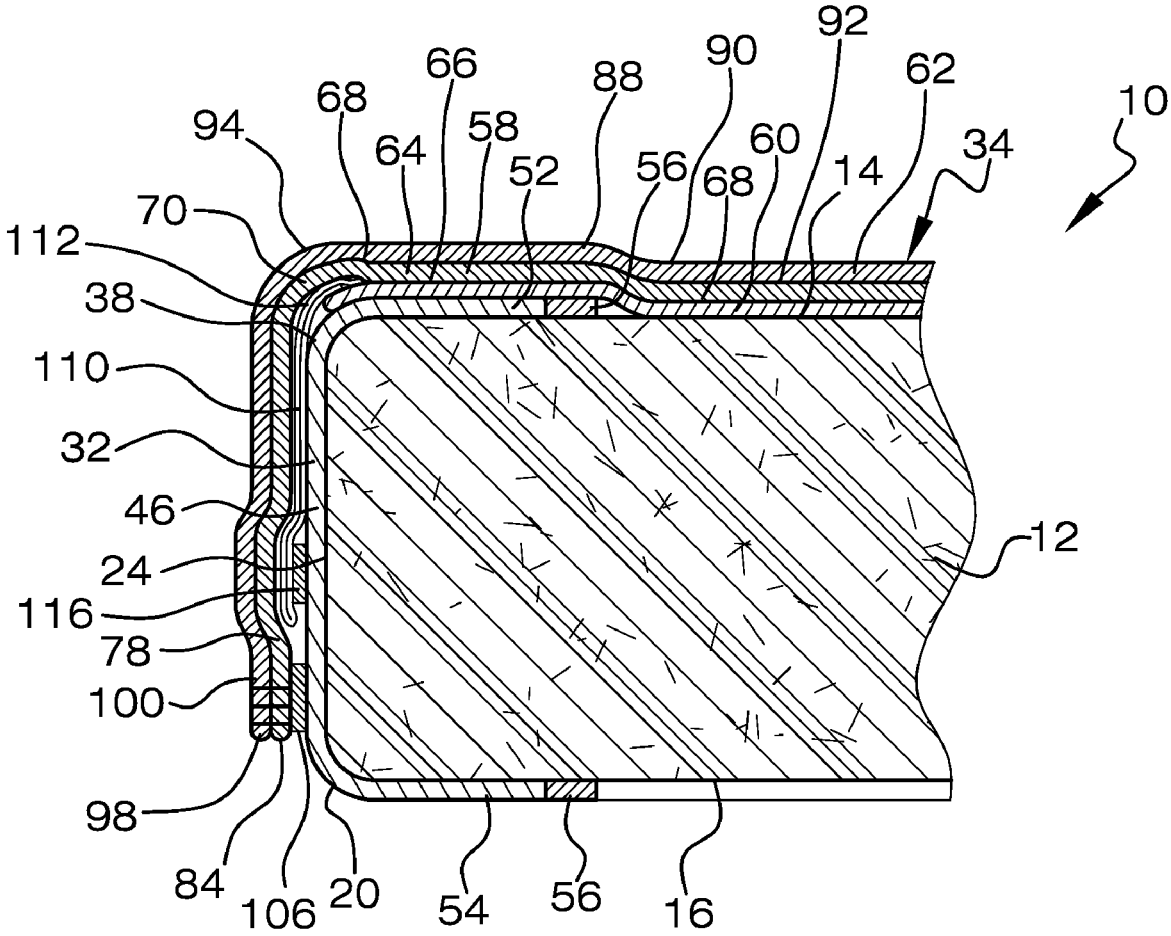
FIG. 3 is a cross section view of the bed clothing assembly and mattress taken along line 3-3 in FIG. 2.
Figure 4:
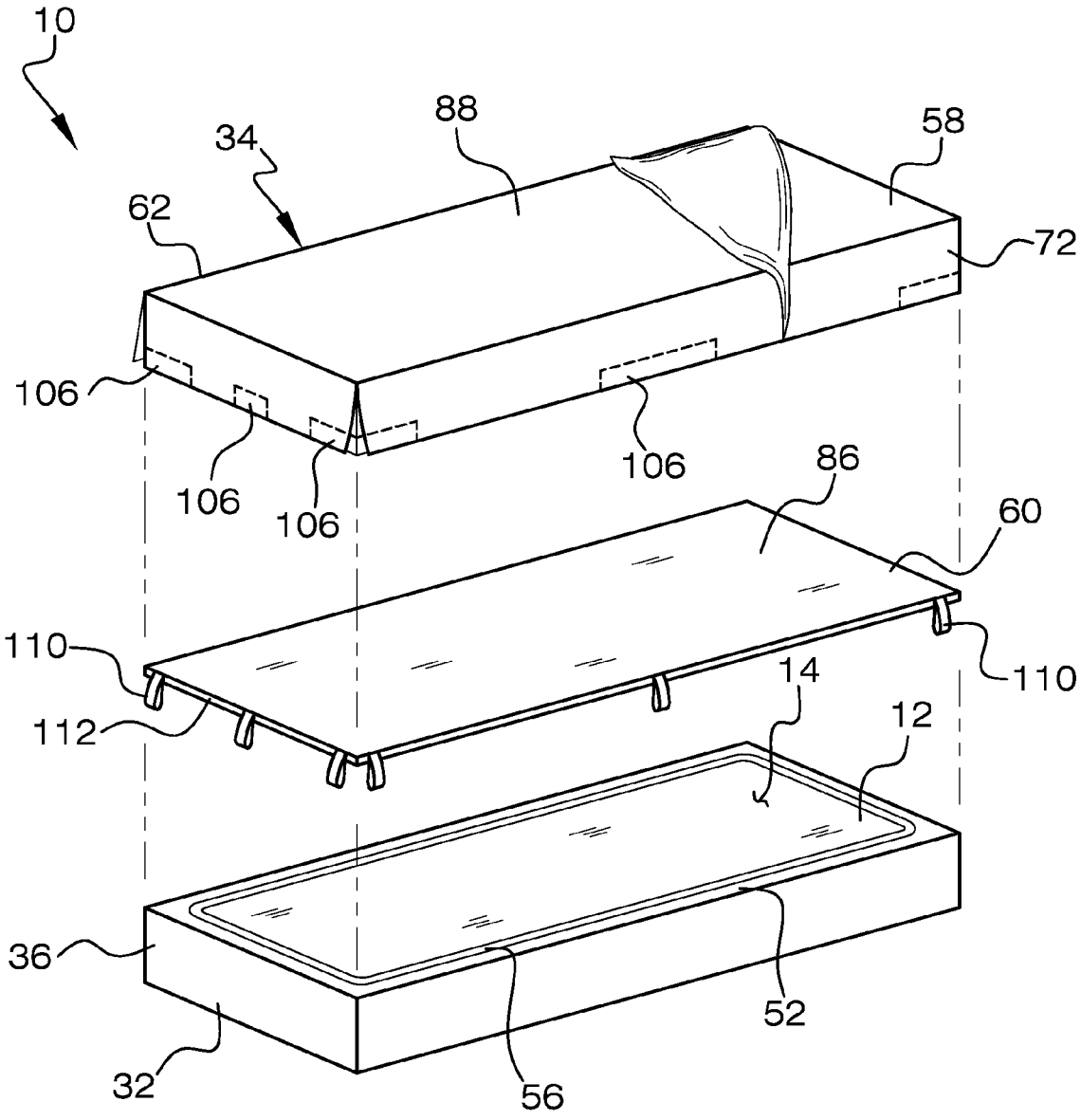
FIG. 4 is a perspective view of the bed clothing assembly showing the mattress band on the mattress and the unitary sheet assembly detached from the mattress band.

In FIGS. 1-4, reference numeral 10 generally designates the bed clothing assembly in accordance with the principals of the present invention. The bed clothing assembly 10 of the present invention is intended to provide a means for the physically disabled to more easily remove and replace bed clothing. In FIG. 1, there is illustrated a perspective exploded view of the individual components of the bed clothing assembly 10 and a conventional mattress 12. The mattress 12 is rectangular, and has top and bottom surfaces 14 and 16, each with a peripheral edge 18 and 20, respectively, and a sidewall 22 extending between the peripheral edges. The bottom surface 16 of the mattress 12 is best seen in FIG. 3. Sidewall 22 of the mattress 12 includes end panels 24 and 26, and side panels 28 and 30.

The bed clothing assembly 10 includes a mattress band 32, a unitary sheet assembly 34 and a padded sheet or mattress pad 60. The mattress band 32 is constructed to be securely attached to the mattress 12 and the unitary sheet assembly 34 and the padded sheet 60 are each constructed to be removably attachable to the mattress band 32 in a manner in which they remain secured during usage. The mattress band 32 comprises a sidewall 36 with continuous upper and lower edges 38 and 40. Sidewall 32 can include sides panels 42 and 44, and end panels 46 and 48. The adjacent vertical edges of the side panels 42 and 44 and of the end panels 46 and 48 are joined to form vertical corners 50A, 50B, 50C, and 50D. An upper edge portion 52 extends inwardly from the upper edge 38, and a lower edge portion 54 extends inwardly from the lower edge 40. Bands 56 of elastic material can be attached around the ends 58 and 60 of the upper and lower edge portions 52 and 54 respectively. Bands 56 causes the upper and lower edge portions 52 and 54 to gather and aid in securing the mattress band 32 to the mattress 12. The sidewall 36 of the mattress band 32 encircles the sidewall 22 of the mattress 12, and the upper and lower edge portions 52 and 54 extend inwardly and continuously around the peripheral edges 18 and 20 of the top and bottom surfaces 14 and 18 of the mattress, respectively, when the mattress band is installed on the mattress. The length and width of side panels 42 and 44, and of end panels 46 and 48 are sized to correspond to the length and width of side panels 28 and 30, and of end panels 24 and 26, respectively, of the mattress 12. The mattress band 32 can be partially or entirely constructed of an elastic material, and sized to be slightly smaller than the dimensions of the mattress, and capable of being stretched to conform to the size, shape and dimension of the mattress to which it is attached. The mattress band 32 can be made of an elastic fabric material having a pile that can be removably engaged by a hook fastener portion of a hook-and-loop type fastener.

The unitary sheet assembly 34 includes a bottom sheet 58 and a top sheet 62 connected together forming a single unit. The bottom sheet 58 includes a main panel 64 with top and bottom surfaces 66 and 68, and a peripheral edge 70. A sidewall 72 extends from the main panel 64 continuously around the peripheral edge 70, and includes a peripheral bottom edge 84. Sidewall 72 may be integral with main panel 64. Sidewall 72 can include side panels 74 and 76, and end panels 78 and 80. Adjacent vertical edges of the side panels 74 and 76, and of the end panels 78 and 80 are joined to form vertical corners 82A, 82B, 82C, and 82D. Main panel 64 is sized to equal the top surface 14 of the mattress 12. Side panels 74 and 76 and end panels 78 and 80 are sized to correspond to the length and width of side panels 42 and 44, and of end panels 46 and 48, respectively, of the mattress band 32. Side panels 74 and 76 and end panels 78 and 80 cover side panels 42 and 44, and of end panels 46 and 48, respectively, of the mattress band 32 when attached thereto.

The top sheet 62 includes a main panel 88 with top and bottom surfaces 90 and 92, and a peripheral edge 94. A sidewall 96 extends from the main panel 88 partially around the peripheral edge 94, and includes a peripheral bottom edge 98. Sidewall 96 may be integral with main panel 88. Sidewall 96 can include a foot panel 100 corresponding to end panel 78 of the bottom sheet 58, and side panels 102 and 104 corresponding to side panels 74 and 76, respectively, of the bottom sheet. Foot panel 100 is sized to correspond to the length and width of end panel 78. Side panels 102 and 104 can be sized to correspond the length and width of side panels 74 and 76, respectively, can be sized to have a greater width to drape downward beyond the peripheral bottom edge 84 of the bottom sheet 58, and can be sized to have a greater length to extend beyond the peripheral edge 64 to permit the top sheet opposite of the foot panel 100 to be folded back upon itself. Main panel 88 of the top sheet 62 can be sized to be equal to main panel 64 of the bottom sheet 58.

The peripheral bottom edge 98 along the foot panel 100 of the top sheet 62 and the peripheral bottom edge 84 along end panel 78 of the bottom sheet 58 are continuously stitched together along the lengths thereof with the remaining portion of the peripheral bottom edge 98 along the side panels 102 and 104 of the top sheet free from attachment with the bottom sheet 58. The adjacent vertical edges of foot panel 100 and side panel 102 are separate from each other forming a vertical gap therebetween, and the adjacent vertical edges of foot panel 100 and side panel 104 are separate from each other forming a vertical gap therebetween to permit the side panels 102 and 104 of top sheet 62 to be movable independently from the foot panel 100.

A plurality of hook fasteners 106, such as the hook fastener of a hook-and-loop type fastener, are spaced along the sidewall 72 of the bottom sheet 58. Fasteners 106 are releasably attachable to the fabric material of the sidewall 36 of the mattress band 32 enabling the unitary sheet assembly 34 to be securely attached to the mattress band and remain taut throughout usage. The sidewall 72 of the bottom sheet 58 is continuously coextensive with the sidewall 36 of the mattress band 32 and the bottom surface 66 of the bottom sheet 58 is coextensive with the top surface 14 of the mattress 12 when the unitary sheet assembly 34 is secured to the mattress band. To make detachment easier and to prevent in advent reattachment of the unitary sheet assembly 34 with the mattress band 32, each fastener 106 can be spaced along the peripheral bottom edge 70 of the bottom sheet 58. Even further, the fasteners 106 can be sized such that they do not extend completely up sidewall 72, and are spaced from the upper edge 38 and peripheral edge 70. In this manner, as side panels 74 and 76 and end panels 78 and 80 are sequentially detached from side panels 28 and 30 and end panels 24 and 26, and lifted up it is less likely for prior detached panels to become inadvertently reattached.

The padded sheet 60 has a panel area 86 sized equal to the upper surface 12 of the mattress 12. The padded sheet 60 may have a waterproof barrier layer. A plurality of separate securment straps 110 are spaced along and extend from the peripheral edge 112 of the padded sheet 60. Each strap 110 can be looped to have an opening 114 of a sufficient size to permit the insertion of a hand through the loop to more easily grip the strap. Each strap 110 includes a fastener portion 116 for releasable attachment to the sidewall 36 of the mattress band 32.

In operation, the mattress band 32 is first attached to the mattress 12 by stretching the mattress band 32 over the corners and sides of the mattress such that sidewall 32 encircles the sidewall 22 of the mattress, and the lower edge portion 54 and the upper edge portion 52 extend inwardly and continuously around the peripheral edges 18 and 20 of the top and bottom surfaces 14 and 18 of the mattress, respectively. Once the mattress band 32 is attached to the mattress 12, the mattress no longer needs to be lifted or otherwise maneuvered in the attachment or detachment of the unitary sheet assembly 34, thereby making changing of the bedding easier and with less strain. With the mattress band 32 attached to the mattress 12, the unitary sheet assembly 34 can be placed on top of the mattress with the foot panel 100 at the foot of the mattress. Sidewall 72 can then be attached to the sidewall 36 of the mattress band 32 by simply pulling the sidewall 72 down and about sidewall 36 and engaging the cooperating fasteners 106. In this manner, the bottom sheet 58, the padded sheet 60 and the top sheet 62 are each simultaneously positioned correctly on the mattress in a single step without requiring lifting of the mattress. The top sheet 62 may need to be adjusted and pulled upward along the top of the mattress 12 as desired.

A number of embodiments of the present invention have been described. Nevertheless, it will be understood that various modifications may be made without departing from the spirit and scope of the invention. Accordingly, other embodiments are within the scope of the following claims.

What is claimed is:

1. A bed clothing assembly for a mattress having top and bottom surfaces, and a side wall with opposed ends, and opposed sides extending between peripheral edges of the top and bottom surfaces, the bed clothing assembly comprising:

a mattress band having a sidewall with continuous upper and lower edges, said sidewall including side panels and ends panels for covering the sides and ends, respectively, of the mattress, adjacent vertical edges of said side panels and said end panels of said mattress band being joined to form vertical corners, said mattress band further having an upper edge portion extending inwardly from said sidewall, and a lower edge portion extending inwardly from said sidewall, wherein said sidewall of said mattress band encircles the sidewall of the mattress, and said upper and lower edge portions extending inwardly and continuously around the peripheral edges of the top and bottom surfaces of the mattress, respectively, when said mattress band is installed on the mattress; a unitary sheet assembly for overlaying the mattress; said unitary sheet assembly including: a bottom sheet having a main panel with top and bottom surfaces and a peripheral edge, said bottom sheet having a sidewall extending from said main panel thereof continuously around said peripheral edge of said main panel, said sidewall of said bottom sheet including side panels and end panels for covering the side panels and end panels, respectively, of said mattress band, adjacent vertical edges of said side panels and said end panels of said bottom sheet being joined to form vertical corners, said sidewall of said bottom sheet having a peripheral bottom edge, said main panel of said bottom sheet being sized equal to the top surface of the mattress; a top sheet having a main panel with top and bottom surfaces and a peripheral edge, said top sheet having a sidewall extending from said peripheral edge of said main panel, said sidewall of said top sheet including a foot panel and side panels for covering one end panel of said end panels and said side panels, respectively, of said sidewall of said bottom sheet, said sidewall of said top sheet having a peripheral bottom edge, adjacent vertical edges of said foot panel and said side panels of said top sheet being separate and forming vertical gaps therebetween; said peripheral bottom edge along said foot panel of said top sheet and said peripheral bottom edge along a cooperating end panel of said bottom sheet being continuously attached together along the entire lengths thereof with the remaining portion of said peripheral bottom edge along said side panels of said top sheet being free from attachment to said bottom sheet; and a first attachment means for removably attaching said unitary sheet assembly to said mattress band with said sidewall of said bottom sheet coextensive with said sidewall of said mattress band, a padded sheet for overlaying the mattress and having a panel area sized equal to the top surface of the mattress; and second attachment means for removably attaching said padded sheet to said mattress band with said padded sheet positioned intermediate said bottom sheet and the upper surface of the mattress, wherein said attachment means attaches said sidewall of said bottom sheet to said sidewall of said mattress band; wherein said second attachment means includes a plurality of looped straps extending from and space along a peripheral edge of said padded sheet, and a hook fastener portion on each looped strap that is engagable with said sidewall of said mattress band.

2. The bed clothing assembly of claim 1, wherein said main panel of said bottom sheet is sized equal to the top surface of the mattress.

3. The bed clothing assembly of claim 1, wherein said first attachment means includes a plurality of hook fasteners spaced along said peripheral bottom edge of said sidewall of said bottom sheet, each of said plurality of hook fasteners engagable with said sidewall of said mattress band.

4. The bed clothing assembly of claim 1, further comprising:

an elasticized material around the ends of each of said upper edge portion and said lower edge portion.

* * * * *